US006904612B2

(12) United States Patent
Spongberg

(10) Patent No.: US 6,904,612 B2
(45) Date of Patent: Jun. 14, 2005

(54) WEATHER AND CLIMATE ADAPTIVE HALLOWEEN COSTUME

(75) Inventor: Rod Spongberg, Long Beach, NY (US)

(73) Assignee: Chosun International, Inc., New York, NY (US)

( * ) Notice: Subject to any disclaimer, the term of this patent is extended or adjusted under 35 U.S.C. 154(b) by 0 days.

(21) Appl. No.: 10/104,483

(22) Filed: Mar. 22, 2002

(65) Prior Publication Data

US 2003/0177562 A1 Sep. 25, 2003

(51) Int. Cl.[7] ..... A41D 5/00
(52) U.S. Cl. ..... 2/69; 2/DIG. 1
(58) Field of Search ..... 2/69, 69.5, 209.13, 2/75, 206, 84, 80, 173, 171, 98, 244, 202, 204, 205, 199, 115, DIG. 1

(56) References Cited

U.S. PATENT DOCUMENTS 395,189 A * 12/1888 Stanton ..... 2/1
D158,915 S * 6/1950 Voss ..... D2/741
3,373,446 A * 3/1968 Verderame ..... 2/173
3,382,504 A * 5/1968 Barbosa ..... 2/80
4,154,183 A * 5/1979 Nunez ..... 2/302
4,175,411 A * 11/1979 Allen et al. ..... 2/173
4,451,933 A * 6/1984 Seng et al. ..... 2/202
D279,042 S * 6/1985 Aquilina et al. ..... D2/743
D283,172 S * 4/1986 Johnson ..... D2/741
D285,815 S * 9/1986 Finn ..... D2/831
4,660,033 A * 4/1987 Brandt ..... 340/825.72
4,722,098 A * 2/1988 Stapleton ..... 2/69
4,722,099 A * 2/1988 Kratz ..... 2/79
4,813,081 A * 3/1989 Cliff et al. ..... 2/115
4,928,321 A * 5/1990 Dobson ..... 2/84
4,996,723 A * 3/1991 Huhn et al. ..... 2/105
5,105,477 A * 4/1992 Golde ..... 2/93
5,105,478 A * 4/1992 Pyc ..... 2/115
5,170,506 A 12/1992 Lewis, Jr. et al.
5,201,075 A * 4/1993 Svetich ..... 2/108
5,214,797 A * 6/1993 Tisdale ..... 2/455
5,546,604 A * 8/1996 Geller ..... 2/202
5,752,277 A 5/1998 Van Der Sleesen
6,041,436 A * 3/2000 Keen ..... 2/69
6,061,830 A * 5/2000 Geller ..... 2/69
6,125,472 A * 10/2000 Nakagawa ..... 2/115
6,163,887 A * 12/2000 Rogers et al. ..... 2/173
6,173,450 B1 * 1/2001 Hari ..... 2/69
6,231,488 B1 * 5/2001 Dicker et al. ..... 482/124
6,263,511 B1 7/2001 Moretti
6,332,221 B1 * 12/2001 Gracey ..... 2/69
6,357,049 B1 * 3/2002 Hoffman ..... 2/69
6,442,760 B2 * 9/2002 Moretti ..... 2/115
6,499,141 B1 * 12/2002 Egnew ..... 2/69
6,536,044 B2 * 3/2003 Watley ..... 2/4

OTHER PUBLICATIONS http://www.facemakersincorporated.com/ Updated Sep. 26, 2001, Facemakers, Inc. Turkeys; Costume Information: Birds; Facemakers, Inc. Price Lists; Facemakers, Inc. Pelicans and Facemakers, Inc. Peacocks.*

* cited by examiner

*Primary Examiner*—John J. Calvert
*Assistant Examiner*—Alissa L. Hoey
(74) *Attorney, Agent, or Firm*—Kirkpatrick & Lockhart Nicholson Graham LLP; Anthony H. Handal

(57) ABSTRACT

A Halloween costume particularly adapted to accommodate changes in weather and climate is disclosed. The Halloween costume may be sold in varied geography and be worn regardless of seasonal and whether variation. The inventive Halloween costume comprises several garment member portions which completely define the appearance of the Halloween character. The insulative material is disposed over at least a portion of the first garment base member portion. Another portion of the costume comprises a venting material which functions as a ventilator for the Halloween costume. At least one decorative member is secured to the Halloween costume. The decorative member further outlines the appearance of the Halloween character.

37 Claims, 10 Drawing Sheets

24
14
26
10
62

14
12
24
16
14
10
18
52
52
20
22
54
54
64
28
30
30
74
62
28
68
68
32
32
32
32
32
56
56
64
74
58

34
34
58
70
60
60
36
36
36
36
72

WEATHER AND CLIMATE ADAPTIVE HALLOWEEN COSTUME

STATEMENT REGARDING FEDERALLY SPONSORED RESEARCH OR DEVELOPMENT

Not Applicable

BACKGROUND

Traditionally, Halloween costumes started as relatively unelaborate arrangements. Simple dime store masks which only covered the eyes, wild west robber masks comprising a simple handkerchief taken from the household stock, and perhaps homemade makeups like burnt cork, mom's makeup, cherry juice or the like were all within the range of acceptable getups for Halloween.

With increasing prosperity and the technology which fostered it, Halloween getups and related items began to evolve into increasingly elaborate forms. For example, there emerged widespread availability of colored pastel chalks for making up the face, accessories such as jack o lantern baskets, and masks meant to simulate various traditional figures associated with the Halloween holiday, such as witches, goblins, devils, and so forth. At approximately the same time, there also emerged the commercial Halloween costume, usually a relatively inexpensive low quality product made of relatively light weight synthetic materials printed with material intended to simulate the particular personality which the costume was meant to emulate, such as a skeleton, witch, or other fantastical creature.

Successful Halloween costumes must meet numerous criteria. They must be attractive, they must be comfortable to wear, and they should be inexpensive. In addition, in order to avoid marketing problems, costumes should be functional over a wide range of climates, and for each of those climates over a wide range of weather conditions typical of those climates during the mid fall period. For example, if a Halloween costume is to be marketed nationwide, it must be comfortable in relatively hot fall weather for the state of Texas as well as relatively cold fall weather for the state of Maine. At the same time, it should also function well in other states for both relatively hot and relatively cold weather conditions. The difference in climate between, for example, New York and South Carolina is not insignificant. In addition, because weather is not predictable, a Halloween costume bought for wearing on Halloween must be wearable whether the weather turns out to be relatively hot or relatively cold. Unlike regular clothing, where the child has a wardrobe with numerous garments suitable for various weather conditions, a Halloween costume is generally a single item in a child's wardrobe and will be worn only once. The problem is compounded because the costume must be purchased a week or perhaps even a month before Halloween, when weather conditions can hardly be anticipated.

In connection with accommodating variations in temperature, it is noted that increases in temperature cause far more serious problems than decreases in temperature. In particular, increases in temperature, particularly with a costume made of plush material will result in overheating. On the other hand, decreases in temperature can be accommodated by wearing extra clothing, such as a sweater, gloves or the like.

In addition, not only must the wearer be subject to changes in temperature, it is also necessary that the wearer deal with changes in humidity. Increases in humidity can be just as serious as increases in temperature in the higher temperature ranges. Failure to take into account the factors of temperature and humidity, and also other factors such as expected levels of physical activity, and other aspects of the wearing of a Halloween costume, can result in extreme discomfort and, potentially, illness.

In recent years, the increasing popularity of plush materials in stuffed animal toys has, not surprisingly, suggested the use of this material in Halloween costumes. While the substitution of plush, that is a fabric with a fur-like outer surface and a woven backer, in principal, for traditional Halloween costume materials may be made by simple substitution, the same gives rise to a number of problems, as discussed above.

SUMMARY OF THE INVENTION

Plush is a relatively dense and insulative material and tends to hold in both heat and moisture. In addition, the desire, for aesthetic reasons, to make plush costumes of the type which completely cover the wearer, including a head portion, arm portions, leg portions, and of course, body portions, compounds the problems that can be caused by the insulative properties of plush.

In addition to the above problems, the costume must accommodate not only losses of humidity, but also losses of heat in order to maintain comfort. These objectives are achieved in accordance with the present invention. In particular, in accordance with the invention, the above objectives are achieved through the use of venting. Venting is accomplished using a mesh, net-like material, or other ventilated fabric in the fabrication of the costume. Such venting materials are used in a range of colors, textures and other physical appearances designed to compliment the appearance of the Halloween costume. At the same time, in accordance with the invention, venting materials are placed, to the extent possible, in areas not visible from the front of the inventive costume. In addition, in accordance with the invention, venting is placed at the ends of the extremities, that is adjacent to wrists and ankles, around the neck, under the arms and in the back of the costume. Further, in accordance with the present invention, relatively large areas of venting material are situated on the inventive Halloween costume in such a manner that they appear as relatively small areas, thus maintaining large venting areas at the interface between potentially too humid or too hot air inside the costume and the ambient, thus promoting transfer of heat and humidity through venting. However, in certain instances, as alluded to above, the venting material has a smaller apparent area.

This is achieved by ruffling or crumpling the venting material to reduce apparent costume area while still maintaining venting area. The same is achieved by putting venting material adjacent to the normally elastic cuffs of a costume adjacent to the wrist and extending up the arm toward the body. This same structure is also applied to elastic cuffs at the bottom of the pants portion of a costume adjacent the ankles of the wearer. It is noted that these cuffs contain an elastic member in order to give the costume some form and to prevent drafts.

The inventive Halloween costume comprises a first garment base member portion generally defining the shape of at least a portion of a Halloween character to define the appearance of the Halloween character. The first garment base member portion being configured and dimensioned to be worn by a person. The insulative material is disposed over at least a portion of the first garment base member portion.

The second garment base member portion is secured to the first garment base member portion. The second garment base member portion and the first garment base member portion together define the complete shape on the Halloween character. The second garment base member portion comprises a venting material which functions as a ventilator for the Halloween costume. At least one decorative member is secured to either the first or the second garment base members. The decorative member further outlines the appearance of the Halloween character.

The Halloween costume may be manufactured using the insulative material, such as a fur-like material.

The Halloween costume may be manufactured using such fur-like material as a plush fabric. The Halloween costume comprises a venting material such as netting. The netting material in the Halloween costume may be a textile mesh. The Halloween costume having a complete shape, which defines a cuff and further comprising an elastic member for closing the cuff. The Halloween costume's venting material defines the portion of the cuff and is compressed by the elastic member.

The Halloween costume's complete shape includes a frontal portion and a back portion, and further comprises a zipper extending across the frontal portion or the back portion. The zipper has a length sufficient to enable an individual to put on the suit when the zipper is open.

The Halloween costume's complete shape defines a head portion. The head portion is configured, dimensioned and positioned to serve as a hat for an individual wearing the costume.

The Halloween costume's complete shape defines two arms and a body portion. Also, the costume's complete shape defines two legs.

BRIEF DESCRIPTION OF THE DRAWINGS

These and other objects of the invention will become apparent from the accompanying drawings, in which.

DETAILED DESCRIPTION OF THE BEST MODE OF THE INVENTION

Figures 1, 2:
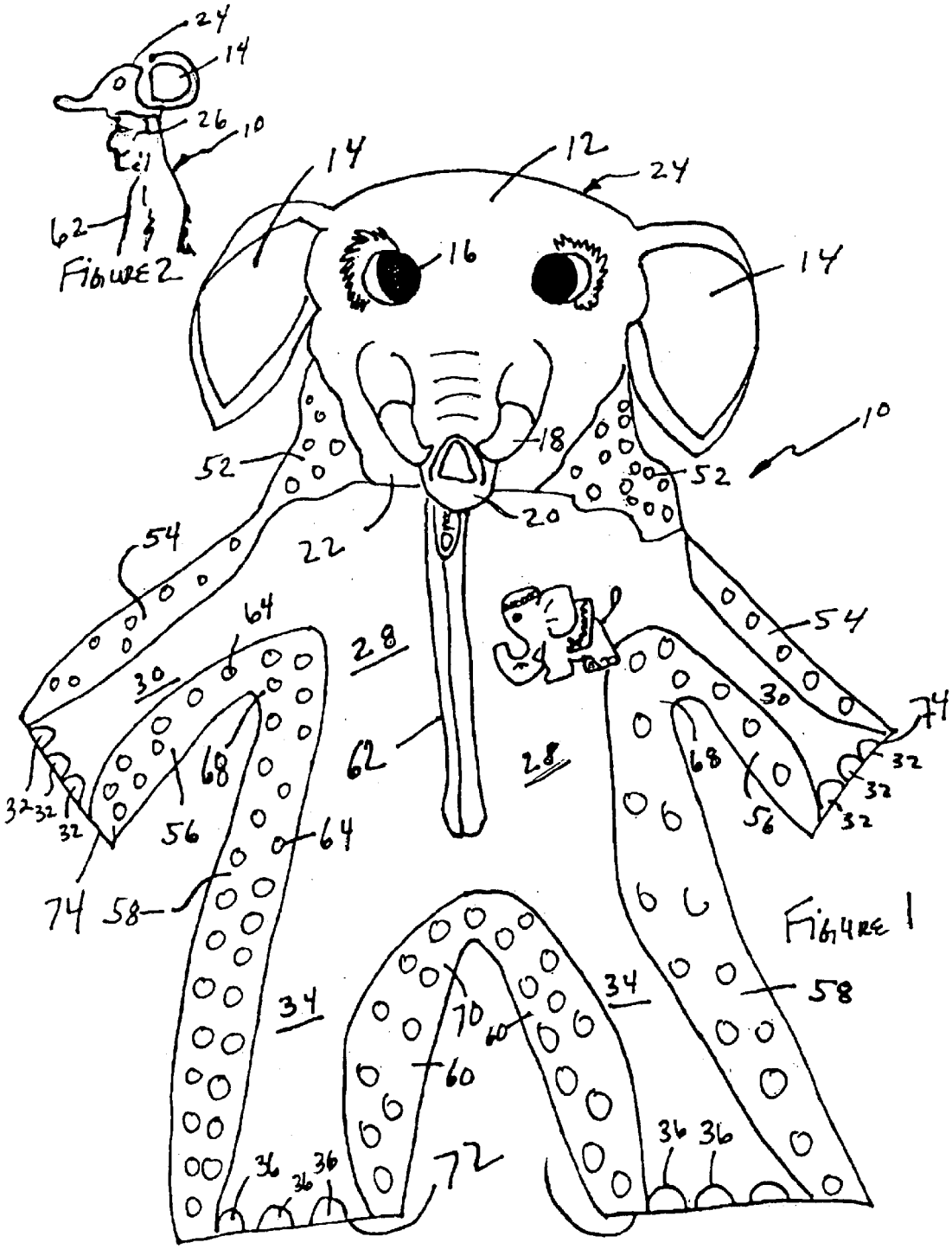
FIG. 1 is a front view of a preferred embodiment of the invention.
FIG. 2 is a side view of a head portion of the invention in its useful position.

Turning to FIG. 1, a costume that can be constructed in accordance with the present invention is illustrated. While the inventive costume may take numerous forms, in the illustrated embodiment costume 10 represents an animal, in particular an elephant.

Costume 10 is comprised of different materials. In particular, the head 12 and ears 14 of the animal are made of plush material. Plastic eyes 16 are provided. Various features of the animal including tusks 18, snout 20, and frontal neck area 22 are also made of plush material. In accordance with the preferred embodiment it is contemplated that the head 24 of the elephant will function as a hat, as illustrated in FIG. 2. This allows the wearer 26 to see clearly, while preserving the appearance of the overall costume.

The costume includes frontal body portions 28 which are also made of plush material. Likewise, frontal arm portions 30 are made of plush and include plush decorations such as elephant claws 32. In accordance with the present invention, it is contemplated that claws 32 are made of plush, perhaps with different characteristics such as color, texture or the like. In addition, claws 32 may be stuffed to protrude from the surface of frontal arm portion 30.

Figure 3:
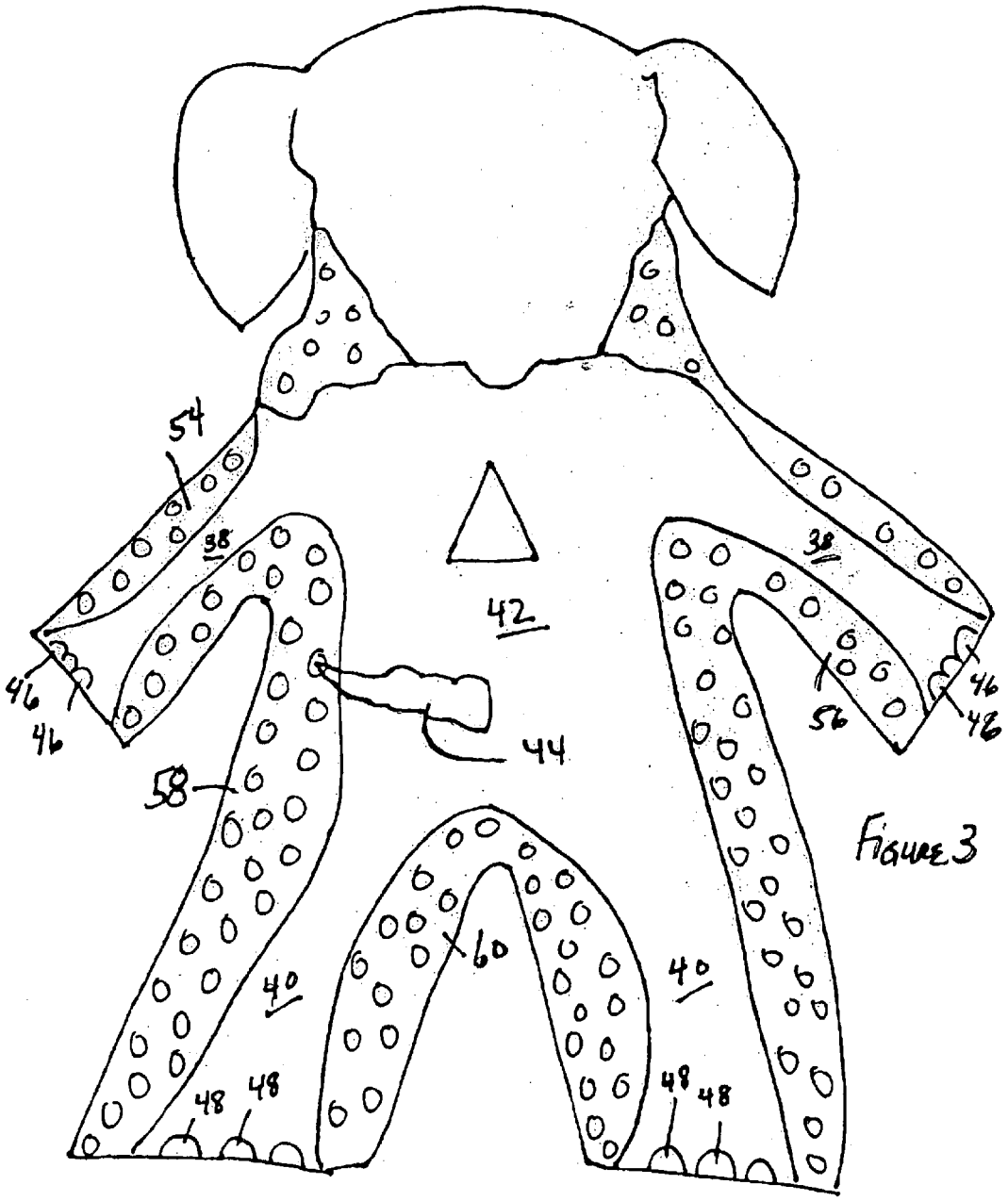
FIG. 3 is a back view of a preferred embodiment of the invention.

Similarly, frontal leg portions 34 are also made of plush material and are decorated with foot claws 36 with are also made of contrasting plush material in accordance with the preferred embodiment. Referring to FIG. 3, the construction of the rear of the suit is similar including rear arm portions 38, rear leg portions 40 and rear body portion 42. The costume also in includes a plush tail 44 mounted on rear body portion 42. Additional decorations or features include claws 46 and 48 which are also made of plush material with, optionally, contrasting color or texture, and optionally maybe stuffed to protrude from the surface of rear arm portion 38.

In accordance with the invention, venting is provided by venting material which is sewn to the plush portions of the costume already described above to complete the body form fitting and body covering suit nature of the costume. In particular, venting material is provided in neck regions 52 along the top length of the arms in region 54 and arm bottom regions 56. Venting is also provided on the sides 58 of costume 10 as well as on the inseam 60 of the inventive costume. The structure of the suit is completed by a frontal zipper 62 (FIG. 1).

In accordance with the invention, any one of numerous materials may be used to provide venting of heat and moisture accumulated within costume 10 when it is worn. Likewise, all venting areas such as neck regions 52, top arms region 54, bottom arms regions 56, sides 58 and inseam 60 may all be made of the same material. Such material may comprise a loosely knitted fabric, or a fabric mesh with large voids or holes 64. Thus, after a child puts on the suit and closes zipper 62, holes 64 act to release moisture and heat.

In accordance with the invention, the provision of venting in certain areas of the costume is particularly important. For example, venting in underarm area 68 as well as inseam area 70 are of particular value.

Referring in particular, it is noted that the cups 72 and 74 are loosely fitting and thus promote venting. This construction is particularly cost effective.

Figure 4:
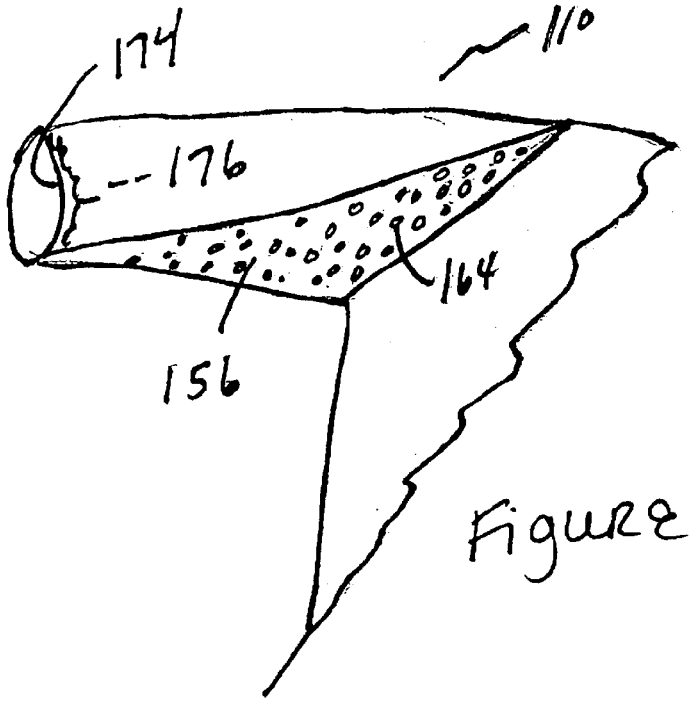
FIG. 4 illustrates an alternative fabric venting material arrangement.

An alternative approach is illustrated in FIG. 4 where fabric venting material 156 in costume 110 includes holes 164. Here the cup 174 is sewn is around an elastic member 176 shown in hidden lines in FIG. 4. The effect of elastic 176 is to squeeze the cuff around the wrist of the wearer, thus causing it to close, and have a more defined aesthetically attractive form. In accordance with this embodiment loss of venting is accommodated by a relatively large area of venting material 156.

Figure 5:
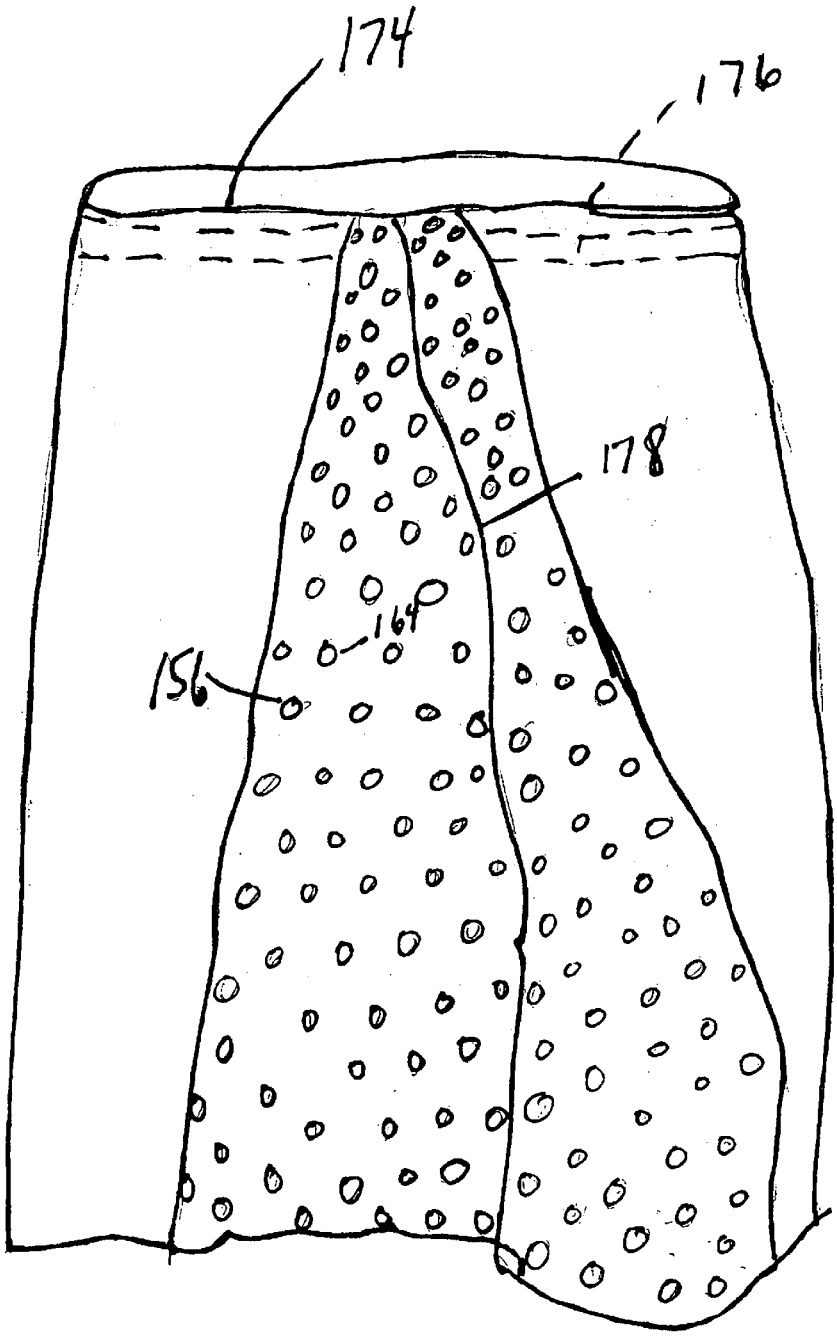
FIG. 5 illustrates cups in compressed position.

In particular, as illustrated in FIG. 5, venting material 156 is crumpled into folds 178, thus giving it a smaller visual appearance, but preserving the overall area of venting material, thus promoting the loss of heat and humidity. Such overall effective area of venting material is effectively utilized during use of the costume, because, as the individual wearing the costume moves, such movement has the effect of compressing and opening up volumes within the costume, thus resulting in the ejection of hot or moist air during compression cycles and the input of cooler and less moist ambient air into the costume thru venting material 156 and holes 164.

Figure 6:
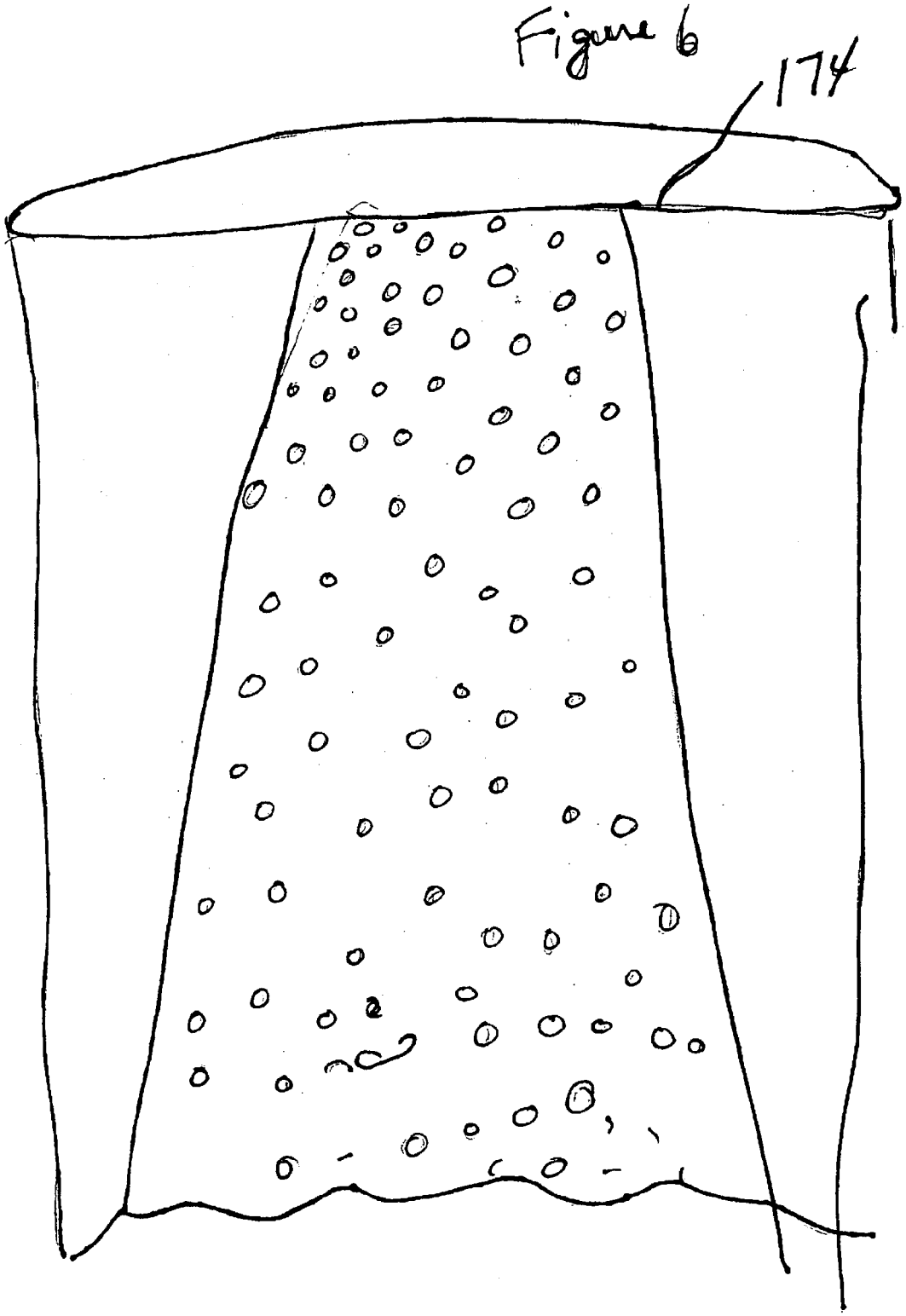
FIG. 6 illustrates cups in stretched out position.

In addition, the inventive costume allows the cups 174 to be opened up and expanded from the compressed position illustrated in FIG. 5 to an open position illustrated in FIG. 6, thus allowing the hands of the user to pass through cuffs 174 after which the cuffs are allowed to elastically return from the stretched out configuration illustrated in FIG. 6 to the unstretched configuration illustrated in FIG. 5.

Figure 7:
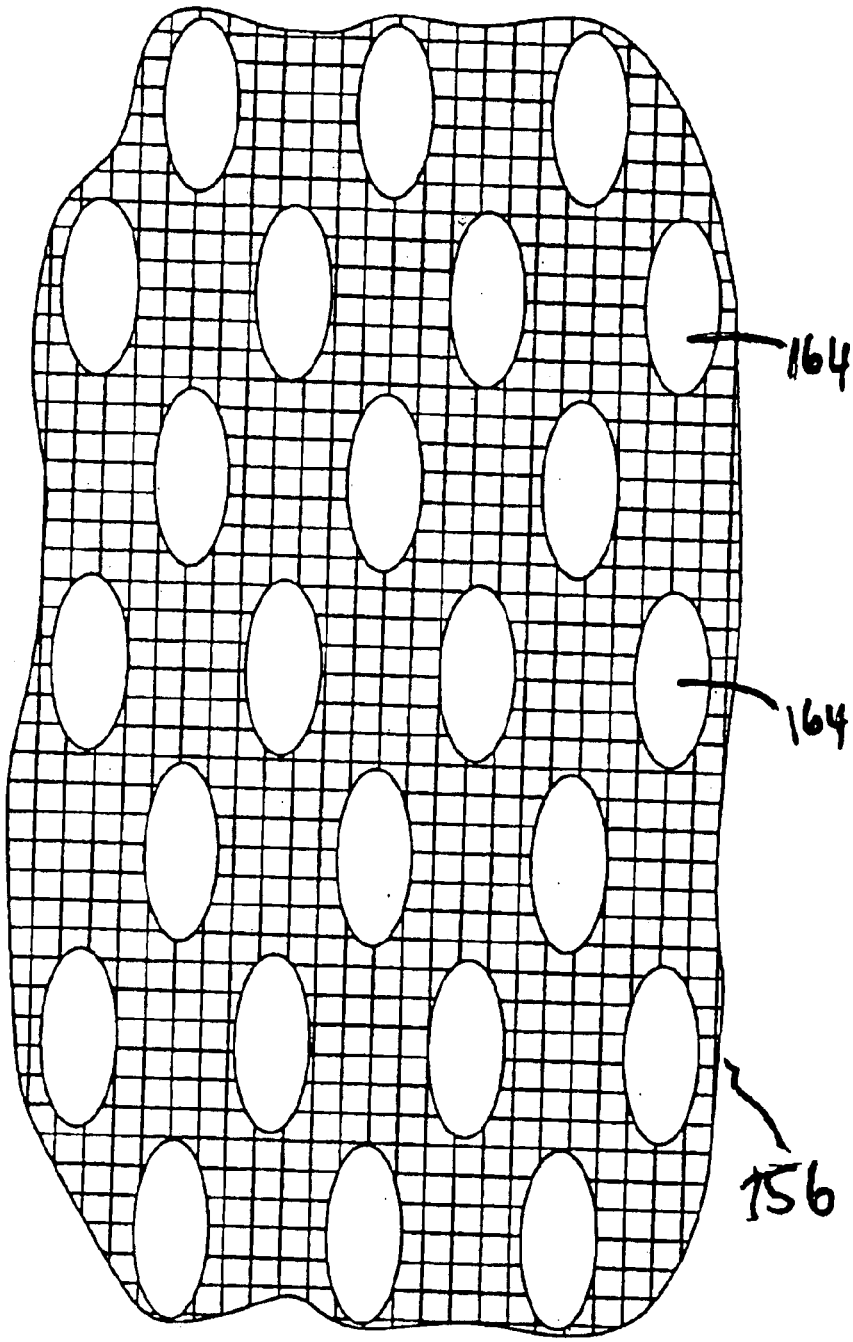
FIG. 7 illustrates a fabric venting material.

A close-up view of venting material 156 is illustrated in FIG. 7. Venting material 156 includes holes 164. Holes 164, are defined in venting material 156. In accordance with the preferred embodiment of the invention, holes 164 are formed during the knitting or weaving of venting material 156. The manner of forming holes in fabric is not a part of the invention and may be accomplished in a number of ways which are known in the art.

Figure 8:
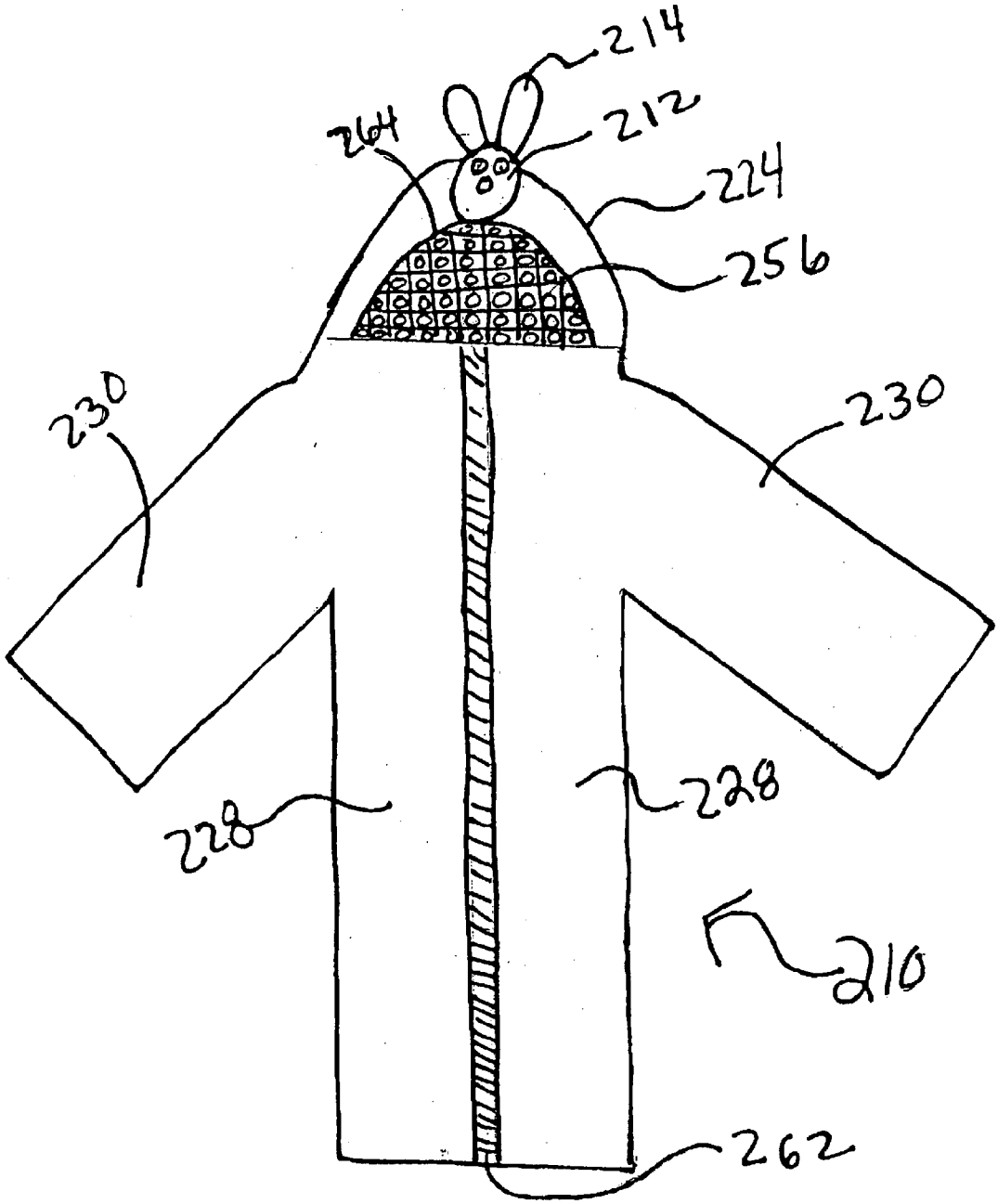
FIG. 8 is a frontal view of an alternative embodiment of the present invention in which venting material is applied to the interior of the hood and neck region such that the plush will not be against a wearer.

An alternative embodiment of the present invention which uses venting material in the head and/or neck area only is illustrated in FIG. 8. This provides venting in the most critical areas. Costume 210 is comprised of a plush material forming a hooded jacket like structure. Attached to hood 224 is a character head 212 and ears 214 which are made of a plush material.

Costume 210 includes a frontal body portion 228 which is made of a plush material. Likewise, frontal arm portions 230 are made of plush and can optionally include plush decoration corresponding to the character illustrated on hood 224. As would be common with a jacket, body portions 228 can be completed using a frontal zipper 262. Body portions 228 can optionally include plush decoration corresponding to the character illustrated on hood 224.

In accordance with the present invention, venting is provided by a venting material 256 which is sewn as a lining for the head area including the scalp, ears, and the back of the neck, into the interior portion of the jacket like structure described above. In particular, venting material 256 is provided in the hood region 224 and neck region 252. Venting material 256 includes holes 264, and acts as a spacer, prompting air flow and comfort. Venting material has absorptive wicking characteristics. The wicking function and evaporation of moisture can be enhanced by using plush as the backer of similar material to form the head portion of the inventive costume, although this is not required. In either case, the natural tendency of plush to breathe helps promote the exhaust of moist air throughout the plush with this function enhanced by the mesh material.

Venting material 256 may be used to provide venting of heat and moisture accumulated within the hood 224 when the same is worn. Venting material 256 provides a space to promote air circulation between the user's head and the plush outer material of hood 224. Venting material 256 is not visible from the outside of costume 210. This provides venting around the periphery of the face hole 266.

Figure 9:
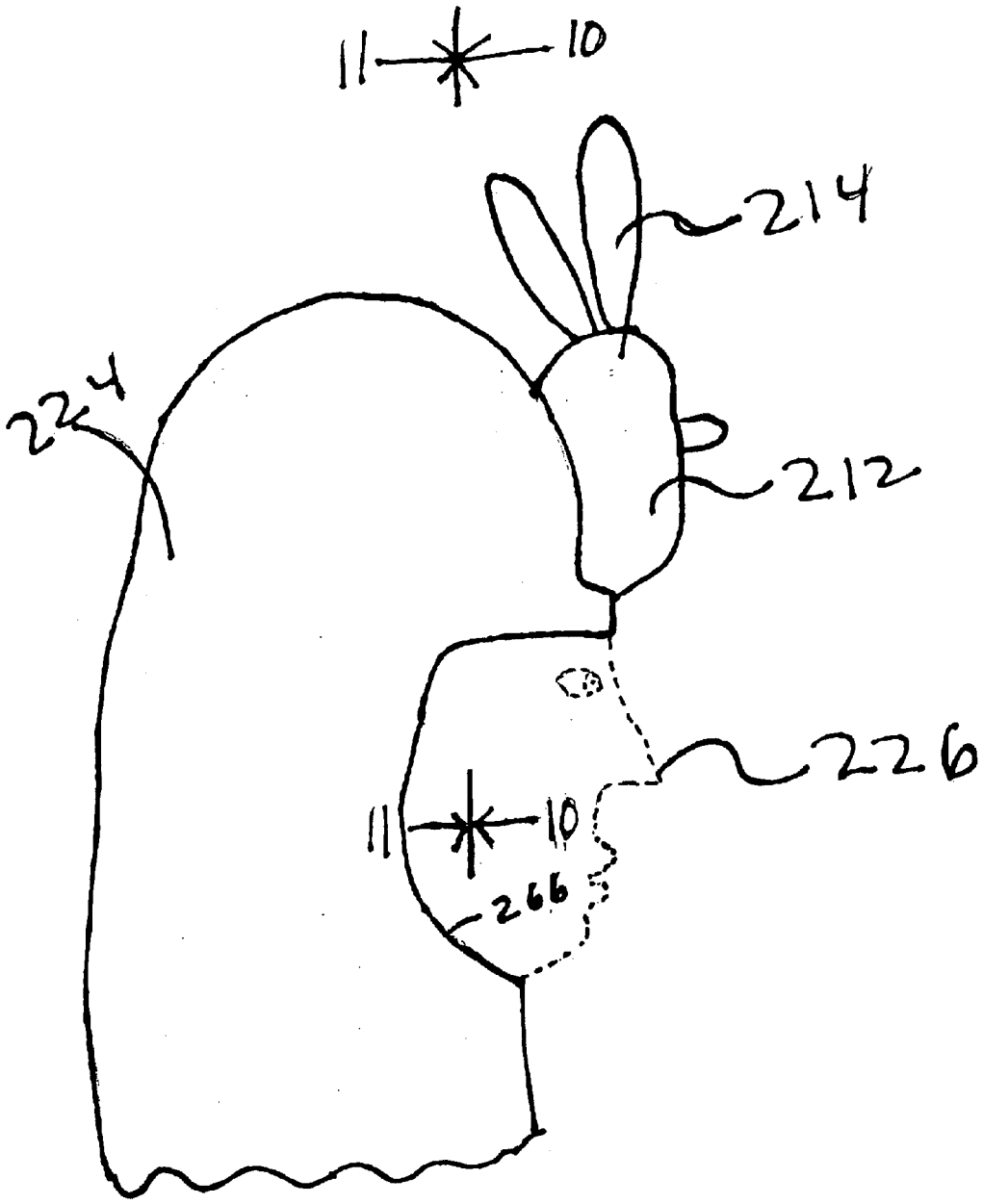
FIG. 9 is a side view of the head portion of the embodiment illustrated in FIG. 8.

Referring now to FIG. 9, it is a close-up view of hood region 224 previously described, illustrating in further detail the relationship of hood 224, and user 226. Further illustrated in FIG. 9 is the relationship of a character figure with the characters head to 12 and ears to 14 on hood 224.

Figure 10:
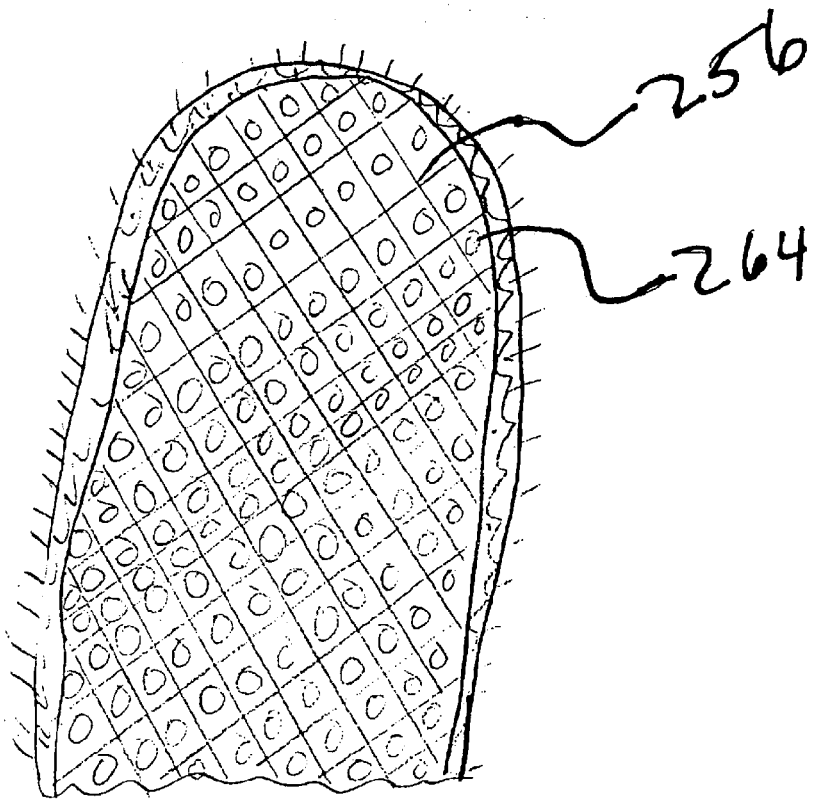
FIG. 10 illustrates a cross-section of the embodiment illustrated in FIG. 9 along lines 10—10.
Figure 11:
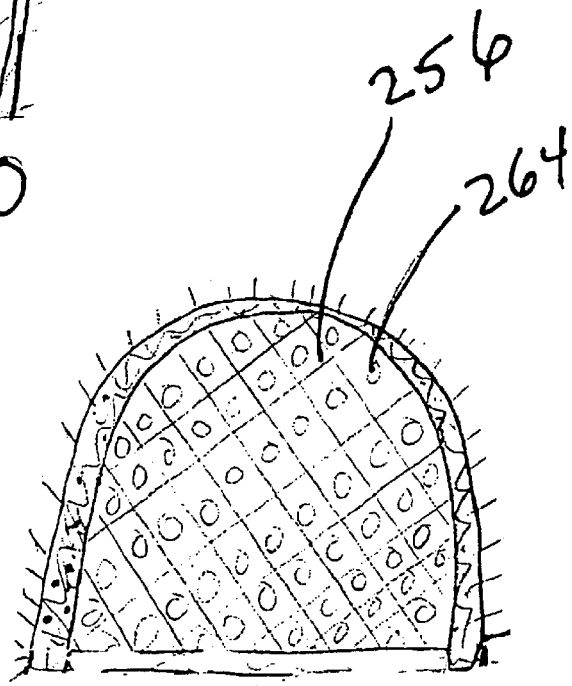
FIG. 11 illustrates a cross-section of the embodiment illustrated in FIG. 9 along lines 11—11.

FIGS. 10 and 11 illustrate a cross-section view inside hood region 224 showing the full inside of the rear and the front of hood 224, respectively, are lined with the venting material 256, comprising holes 264.

It is also intended within the scope of the present invention to include an embodiment in which the full inside surface of the costume 210, or parts there of, are lined with venting material 256.

Figure 12:
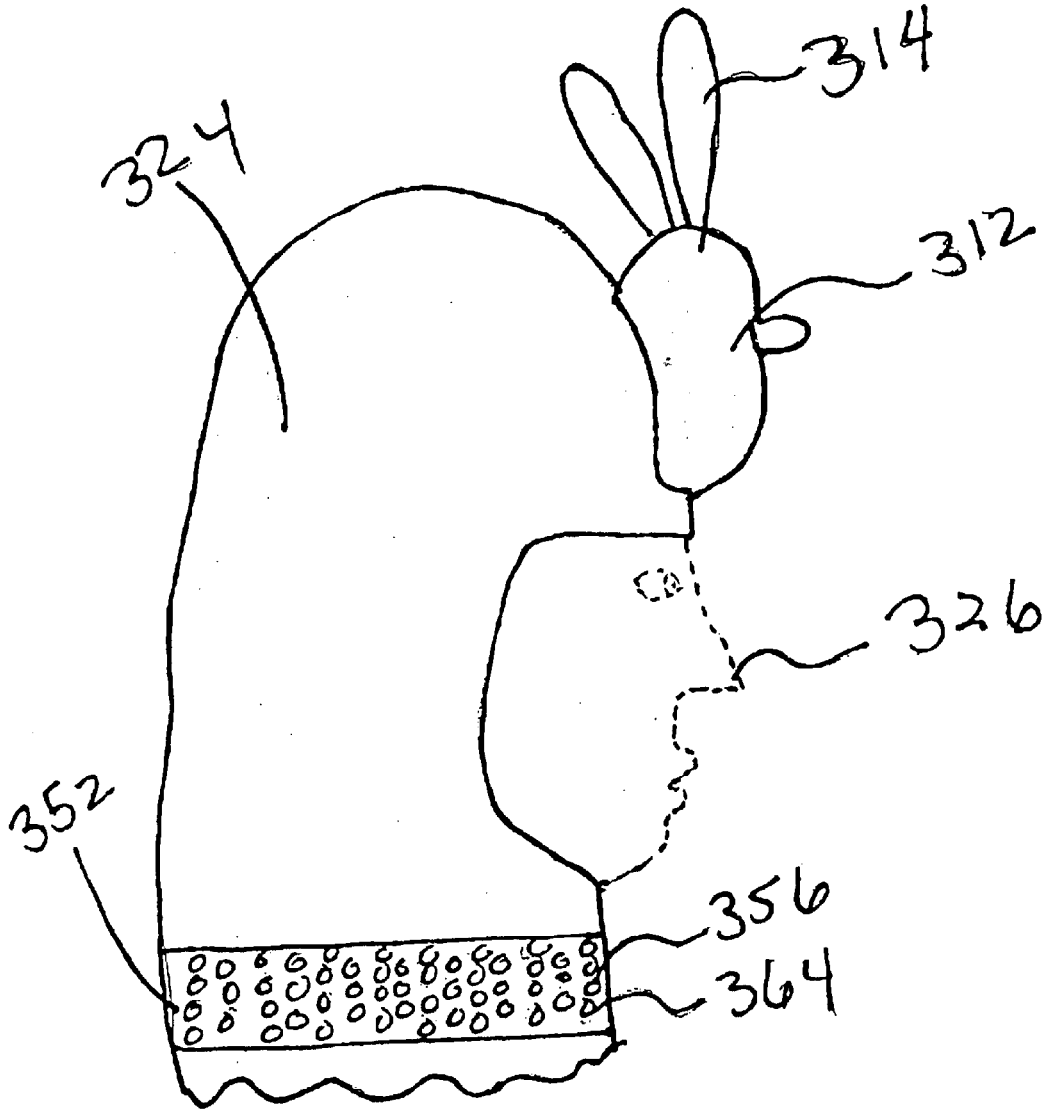
FIG. 12 is a side view of an alternative embodiment of the present invention in which venting material is sewn into the neck region such that the venting material can be seen from the outside of the costume.

Referring now to FIG. 12, an alternative embodiment similar to the FIGS. 8–9 embodiment, but with additional venting in hood region 324 is illustrated. Venting material 356 is sewn into neck region 352. Venting material 356 can be seen from the outside of costume 310. It is intended within the scope of the present invention wherein a costume 310 can have venting material 356 in other areas where the same is viewable from the outside of costume 310. It is also intended within the scope of the present invention to have a costume 310 wherein venting material 356 is in areas where the same is viewable from the outside of costume 310, and also have venting material 356 in areas of costume 310 that are not visible from the outside of costume 310.

Figure 13:
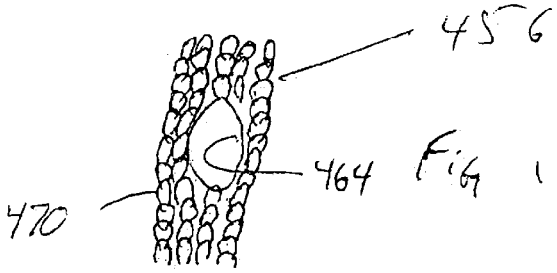
FIG. 13 is a plan view of one type of mesh fabric that can be employed in practicing the invention.
Figure 14:
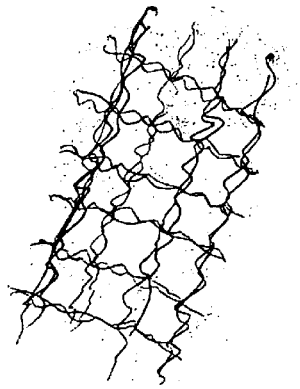
FIG. 14 is a plan view of one type of mesh fabric that can be employed in practicing the invention.

Referring to FIGS. 13 and 14, various types of mesh fabric which may be used with the invention are illustrated. A knitted mesh 456 comprised of loops of yarn 470 knitted to define holes 464 in a manner known in the knitting industry may not be used. Likewise, a "fisherman's net" mesh 556 defining holes 564 (such as the material employed in T shirts and other garments) may also be used to promote comfort, wicking, evaporation, spacing and air flow.

While an illustrative embodiment of the invention has been disclosed, it is, of course, understood that various modifications will be obvious to those of ordinary skill in the art. Such modifications are within the spirit and scope of the invention which is limited and defined only by the appended claims.

What is claimed is:

1. A costume, comprising:

(a) a first flexible limp garment base member portion comprising plush fabric, said first garment base member portion generally defining the shape of at least a portion of a character when worn as a garment to define the appearance of said character, said first garment base member portion being configured and dimensioned to be worn by a person;

(b) an insulative material disposed over at least a portion of said first garment base member portion;

(c) a second garment base member portion secured to said first garment base member portion, said second garment base member portion and said first garment base member portion together defining the complete shape of said character, said second garment base member portion comprising a venting material, which functions as a ventilator for said costume;

(d) a hood secured to said complete shape; and (e) a plush animal head disposed on said hood.

2. A costume, as in claim 1, wherein said venting material defines holes.

3. A costume, as in claim 2, wherein said venting material is netting.

4. A costume, as in claim 2, wherein said venting material is a textile mesh.

5. A costume, as in claim 1, wherein said complete shape includes a frontal portion and a back portion, and further comprising a zipper extending across said frontal portion or said back portion, said zipper having a length sufficient to enable an individual to put on said suit when said zipper is open.

6. A costume, as in claim 5, wherein said complete shape defines a head portion, said head portion being configured, dimensioned and positioned to serve as a hat for an individual wearing said costume.

7. A costume, as in claim 5, wherein said complete shape defines two arms and a body portion.

8. A costume, as in claim 7, wherein said complete shape defines two legs.

9. A costume, as in claim 1, wherein said complete shape defines a head portion, said head portion being configured, dimensioned and positioned to serve as a hat for an individual wearing said costume.

10. A costume, as in claim 9, wherein said complete shape defines two arms and a body portion.

11. A costume, as in claim 1, wherein said complete shape defines two arms and a body portion.

12. A Halloween costume as claimed in claim 1 wherein said venting material lines said head portion.

13. A Halloween costume as claimed in claim 1 wherein said venting material is proximate to a region of said costume proximate to a user's neck.

14. A Halloween costume, comprising:

(a) a first garment base member portion generally defining the shape of at least a portion of a Halloween character to define the appearance of said Halloween character, said first garment base member portion being configured and dimensioned to be worn by a person;

(b) an insulative material disposed over at least a portion of said first garment base member portion, said insulative material being a fur-like plush fabric;

(c) a second garment base member portion secured to said first garment base member portion, said second garment base member portion and said first garment base member portion together defining the complete shape of said Halloween character, said complete shape defining a cuff, said second garment base member portion comprising a venting material, which functions as a ventilator for said Halloween costume;

(d) at least one decorative member secured to said first and/or said second garment base members, said decorative member further defining said appearance of said Halloween character; and (e) an elastic member for closing said cuff, said venting material defining a portion of said cuff, and said cuff being compressed by said elastic member.

15. A Halloween costume, as in claim 14, wherein said complete shape includes a frontal portion and a back portion, and further comprising a zipper extending across said frontal portion or said back portion, said zipper having a length sufficient to enable an individual to put on said suit when said zipper is open.

16. A Halloween costume, as in claim 15, wherein said complete shape defines a head portion, said head portion being configured, dimensioned and positioned to serve as a hat for an individual wearing said Halloween costume.

17. A Halloween costume, as in claim 16, wherein said complete shape defines two legs.

18. A Halloween costume, as in claim 15, wherein said complete shape defines two arms and a body portion.

19. A Halloween costume, as in claim 15, wherein said complete shape defines two legs.

20. A Halloween costume, as in claim 14, wherein said complete shape defines a head portion, said head portion being configured, dimensioned and positioned to serve as a hat for an individual wearing said Halloween costume.

21. A costume, as in clam 20, wherein said complete shape defines two arms, two legs and a body portion.

22. A costume, as in claim 21, wherein said complete shape defines two legs.

23. A costume as claimed in claim 20, wherein said head portion comprises a hood and stuffed animal head disposed over said hood.

24. A Halloween costume, as in claim 14, wherein said complete shape defines two arms, two legs and a body portion.

25. A Halloween costume, as in claim 24, wherein said complete shape defines two legs.

26. A costume, as in claim 14, wherein said venting material comprises textile netting, said textile netting defining holes being placed at locations on said garment substantially hidden from view.

27. A costume, as in claim 26, wherein said insulative material is a fur-like material.

28. A costume as in claim 26, wherein said complete shape defines a cuff, and further comprising an elastic member for closing said cuff and wherein said venting material defines a portion of said cuff and is compressed by said elastic member.

29. A costume, as in claim 28, wherein said complete shape defines two arms and a body portion.

30. A costume, as in claim 26, wherein said complete shape includes a frontal portion and a back portion, and further comprising a zipper extending across said frontal portion or said back portion, said zipper having a length sufficient to enable an individual to put on said suit when said zipper is open.

31. A costume as in claim 30, wherein said complete shape defines a cuff, and further comprising an elastic member for closing said cuff and wherein said venting material defines a portion of said cuff and is compressed by said elastic member.

32. A costume, as in claim 26, wherein said complete shape defines a head portion, said head portion being configured, dimensioned and positioned to serve as a hat for an individual wearing said costume.

33. A costume as in claim 32, wherein said complete shape defines a cuff, and further comprising an elastic member for closing said cuff and wherein said venting material defines a portion of said cuff and is compressed by said elastic member.

34. A costume, as in claim 26, wherein said complete shape defines two arms and a body portion.

35. A costume, as in claim 34, wherein said complete shape defines two legs.

36. A costume as claimed in claim 14, wherein said venting material is positioned at the extremities and under the arms of the costume.

37. A costume as claimed in claim 14, wherein said venting material is crumpled into folds, giving it a smaller visual appearance, but preserving the overall area of venting material, to promote the loss of heat and humidity.

* * * * *